United States Patent [19]

Nelson

[11] Patent Number: 4,521,649

[45] Date of Patent: Jun. 11, 1985

[54] WATERTIGHT ELECTRICAL RECEPTACLE

[76] Inventor: Gunnar I. Nelson, 100 Lakeshore Dr., Apt. 1656, No. Palm Beach, Fla. 33408

[21] Appl. No.: 501,142

[22] Filed: Jul. 11, 1983

[51] Int. Cl.[3] ..... H01H 9/20

[52] U.S. Cl. ..... 200/50 B

[58] Field of Search ..... 200/50B, 51.09, 51.1

[56] References Cited

U.S. PATENT DOCUMENTS

| | | | |
|---|---|---|---|
| 1,731,417 | 10/1929 | Hartwig | 200/50 B |
| 1,924,691 | 8/1933 | Lofgren | 200/50 B |
| 1,947,634 | 2/1934 | Anderson | 200/50 B |
| 1,971,990 | 8/1934 | Reynolds et al. | 200/50 B |
| 2,015,543 | 9/1935 | Bissell | 200/50 B |
| 2,420,865 | 5/1947 | Conlan | 200/50 B |
| 4,414,440 | 11/1983 | DeCoste | 200/50 B |

*Primary Examiner*—J. R. Scott

*Attorney, Agent, or Firm*—Sheldon H. Parker

[57] ABSTRACT

An interconnection member is located between a circuit breaker actuating member and an electrical pin engaging member. The latching member engages a circuit breaker actuating member to hold the actuating member in a first position. When an electrical pin is inserted into the electrical receptacle, the electrical pin engaging member moves an interconnection member to defeat the latching engagement of the latching member and the circuit breaker actuating member. The circuit breaker is activated when the circuit breaker actuating member is moved to a second position.

9 Claims, 11 Drawing Figures

WATERTIGHT ELECTRICAL RECEPTACLE

BACKGROUND OF THE INVENTION

1. Technical Field

This invention relates to a watertight receptacle in which the electrical contacts of the receptacle are not energized when exposed to human touch and in which the electrical plug withdrawal deenergizes the electrical contacts.

2. Description of the Prior Art

Watertight electrical outlet receptacles have been in use at shoreside and shipboard installations for many years. Essentially, one prime application involves electrically powered refrigerated containers being transported on land with the refrigeration being powered by the transporter. Once at dockside or in place on board ship, the refrigeration unit receives its power from an electrical outlet installation which quite obviously must be watertight due to the wet environment and the associated corrosive problem. Experience has shown that the electrical receptacles, which are typically 220 and 440 volt installations, must not only be protected from the environment but also must not have exposed electrical contacts which can be accidentally or inadvertently contacted by a human.

One approach to the problem has been a design wherein reinsertion of the plug into the receptacle automatically activates the electrical contacts and conversely withdrawal of the plug from the receptacle automatically deactivates the contact. However, in certain applications it has been found that after insertion of the plug, the power must be cycled by manually switching the associated circuit breaker.

In attempting to achieve a design which would overcome these problems it is essential to provide reliability and low cost. These apparently incompatible requirements have limited the degree of success of devices of the prior art.

SUMMARY OF THE INVENTION

It has now been found that the problems encountered with the prior art systems can be overcome through the use of the combination of a spring loaded latch, a return spring, a plug pin follower and a manual operated handle assembly which activates a circuit breaker only when the plug is in place in the receptacle assembly.

The system of the instant invention provides among its advantages, extreme ease of manufacture, reliability and low cost, through the use of an unusually low number of simple parts.

BRIEF DESCRIPTION OF THE DRAWINGS

The objects and advantages of the invention will become more apparent and more readily understood when the following detailed description of the invention is read in conjunction with the drawings wherein.

DESCRIPTION OF THE INVENTION INCLUDING THE BEST MODE

The device of the present invention is a totally waterproof enclosure which employs an extremely low number of movable parts thereby providing surprisingly low cost and reliability.

Figure 1:
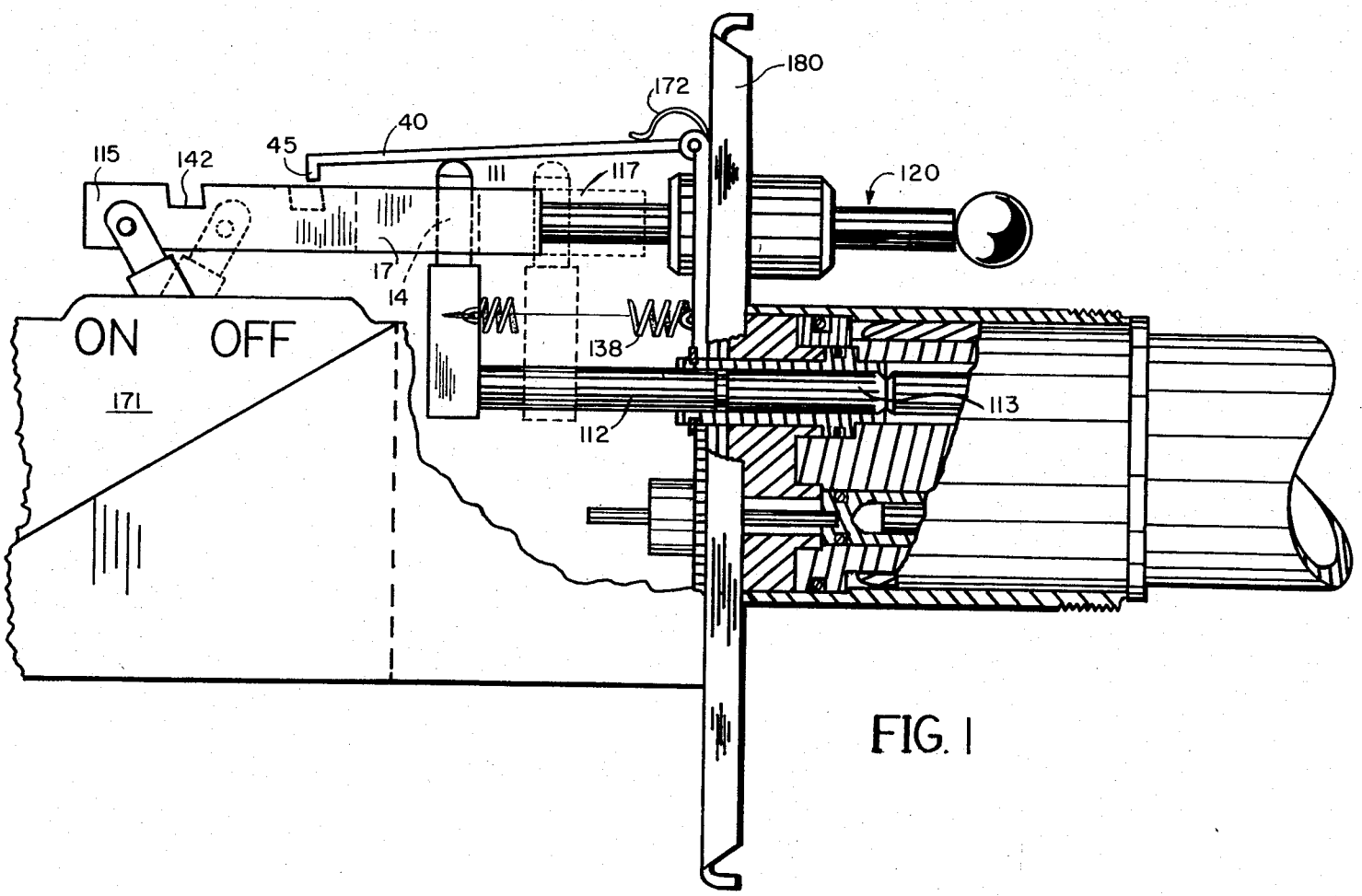
FIG. 1 is a cross-sectional side view of a receptacle in accordance with the present invention.
Figure 2:
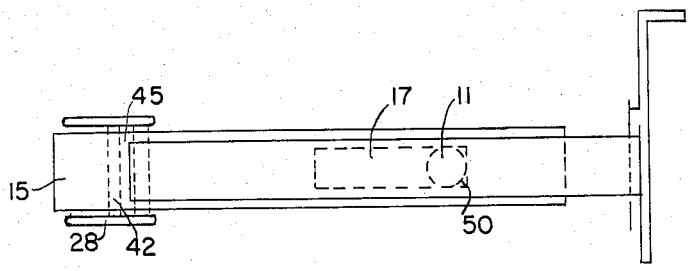
FIG. 2 is a fragmentary top view of the actuating mechanism of the device of FIG. 3.

FIG. 1 is an overall view of the instant invention. FIG. 2 shows a top view of the actuating mechanism of the instant invention. The mechanics of both drawings are defined in detail herein.

Figure 3:
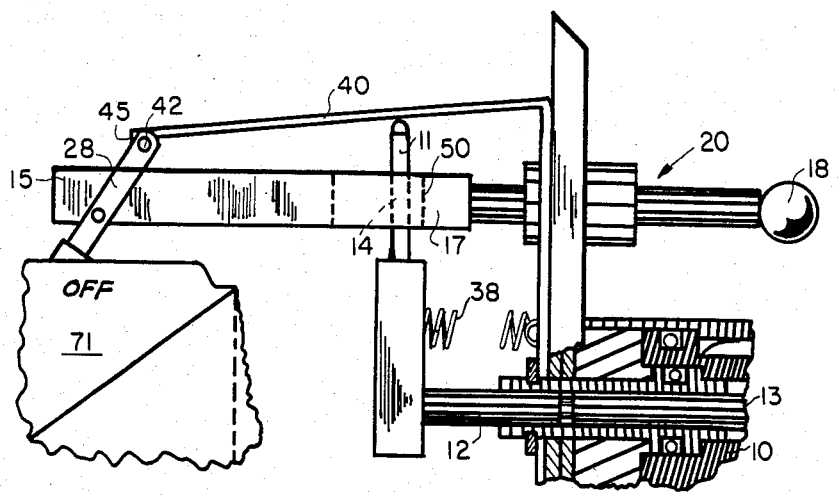
FIG. 3 is a fragmentary side view of the device of FIG. 2, showing a fragmentary portion of a plug ready for insertion.

FIG. 3 illustrates the receptacle of the instant invention with the circuit breaker in the OFF position. The circuit breaker 71 is locked in the OFF position by virtue of pin grip 45 engaging the circuit breaker extension pin 42. In this position the leaf spring latch 40 prevents the receptacle assembly 10 in general and specifically the circuit breaker actuating member 15, from actuating the circuit breaker 71.

Figure 4:
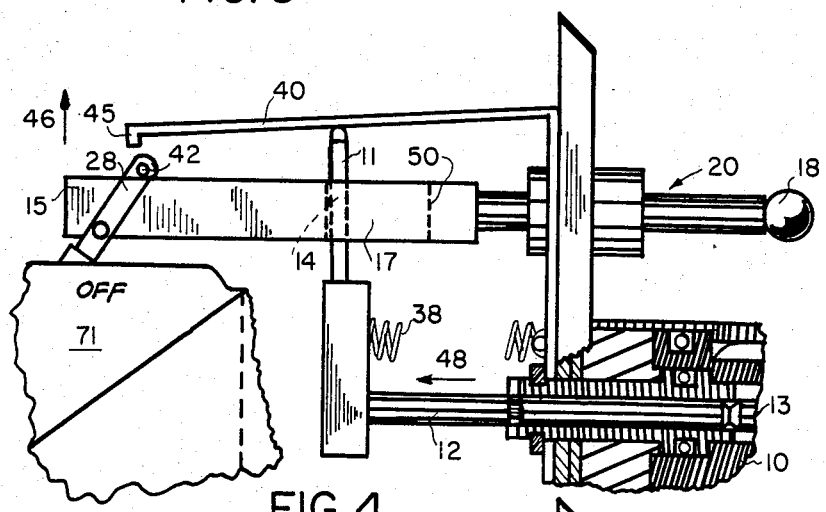
FIG. 4 is a fragmentary side view of the device of FIG. 3 with the plug inserted into the receptacle, thereby permitting the mechanism to be actuated.
Figure 5:
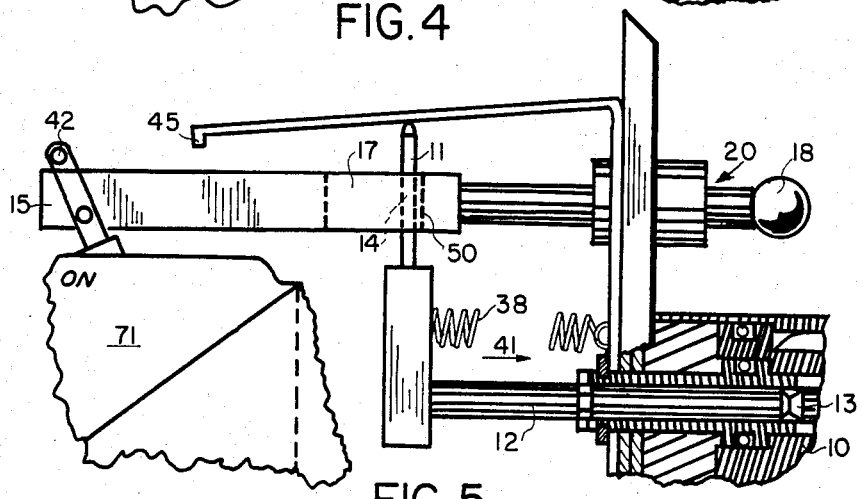
FIG. 5 is a fragmentary side view of the device showing the circuit breaker in the ON position.

In operation, as illustrated in FIG. 4, the male plug is inserted into the receptacle assembly 10. The plug pin 13 then engages the plug follower 12 which then moves in the direction indicated by direction indicating arrow 48. The plug follower actuating member engaging region 14 travels within the plug follower receiving slot 17 thus providing a lost motion connection between the plug follower 12 and the circuit breaker actuating member 15. This action causes the plug follower 12 upper end 11 to engage the leaf spring latch 40, this motion causes the pin grip 45 to move upward as indicated by direction indicating arrow 46 thereby disengaging the circuit breaker extension pin 42. The actuator rod handle 18 and consequently, the manual operating handle assembly 20, including the actuator rod 16, can then be activated and the circuit breaker actuating member 15 moved rearward as indicated in FIG. 5, by direction indicating arrow 48. Thus the circuit breaker 71 can be turned on by the manual operating handle assembly 20, only when a plug pin 13 has moved the plug follower 12 to a rearward position.

As evident from FIG. 5, the reverse operation is encountered when the plug pin 13 is withdrawn from the receptacle assembly 10. The return spring 38 causes the plug pin follower upper end 11 to travel forward as indicated by the direction indicating arrow 41. The forced travel of the manual operating handle assembly returns the circuit breaker 71 to the OFF position, due to the actuating member engaging region 14 contacting the forward edge 50 of the plug pin receiving slot 17 and forcing the forward movement of the actuating member 15.

The circuit breaker extension pin 42 is designed to be unable to pass under the pin grip 45 and is engaged therewith, thus precluding the reverse movement until the plug pin 13 is reinserted in the receptacle assembly 10 as previously described.

Figure 6:
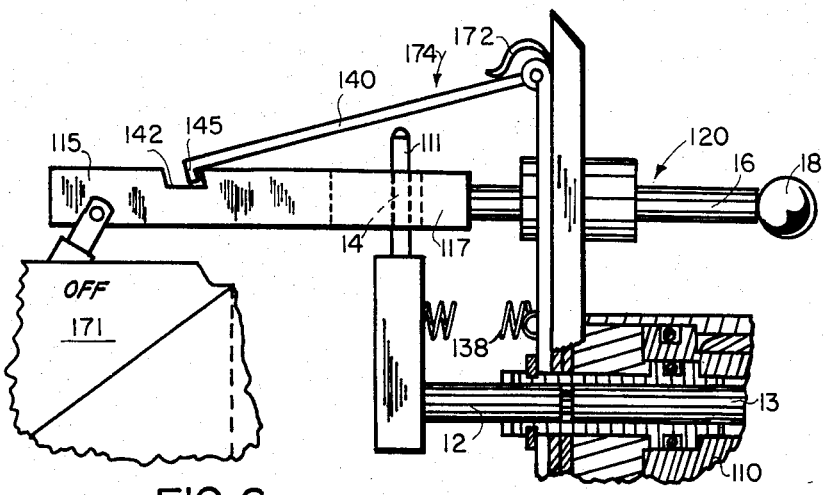
FIG. 6 is a fragmentary side view of an alternative device, showing the mechanism prevented from being actuated, with the plug pin follower and the hinged latch in their positions prior to the plug being inserted into the receptacle.

FIG. 6 illustrates a preferred alternative mechanism. In the embodiment of FIG. 6 the circuit breaker 171 is locked in the OFF position by virtue of a notch grip 145 engaging the circuit breaker operating handle assembly latch notch 142. In this position the hinged latch 140 prevents the operating handle assembly 120, including the actuator rod 16, from actuating the circuit breaker 171. The hinged latch 140 is forced in a counter-clockwise direction as indicated by the direction indicating arrow 174, by means of a torsion spring 172.

Figure 7:
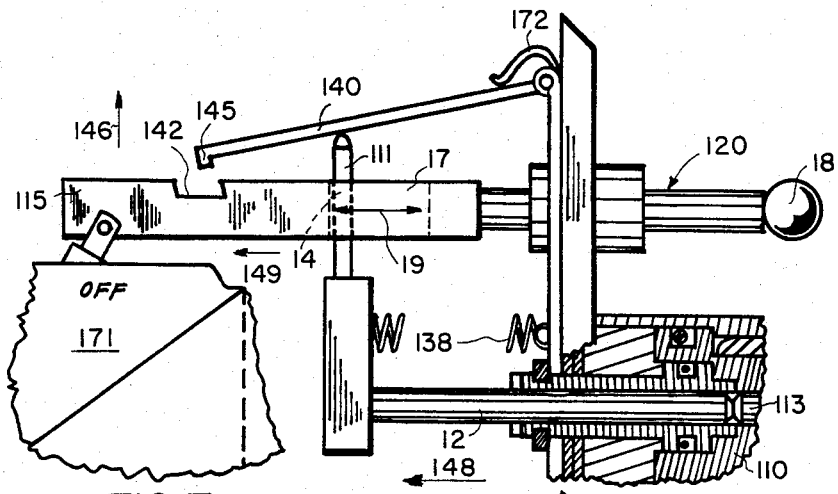
FIG. 7 is a fragmentary side view of the alternative device, showing the position of the plug pin follower and the hinged latch after the plug has been inserted into the receptacle, thereby permitting the mechanism to be actuated.

As evident from FIG. 7, when the plug pin 113 is inserted into the receptacle assembly 110 the plug pin follower 112 moves in the direction indicated by direction indicating arrow 148. The plug pin follower 112 upper end 111 engages the hinged latch 140 causing the notch grip 145 to move upward as indicated by direction indicating arrow 146, thereby disengaging the latch notch 142 and freeing the circuit breaker 171. The circuit breaker actuating member 115 can then be moved rearward as indicated by direction indicating arrow 149 thus causing the circuit breaker 171 to be turned ON by the manual operating handle assembly 120.

Figure 8:
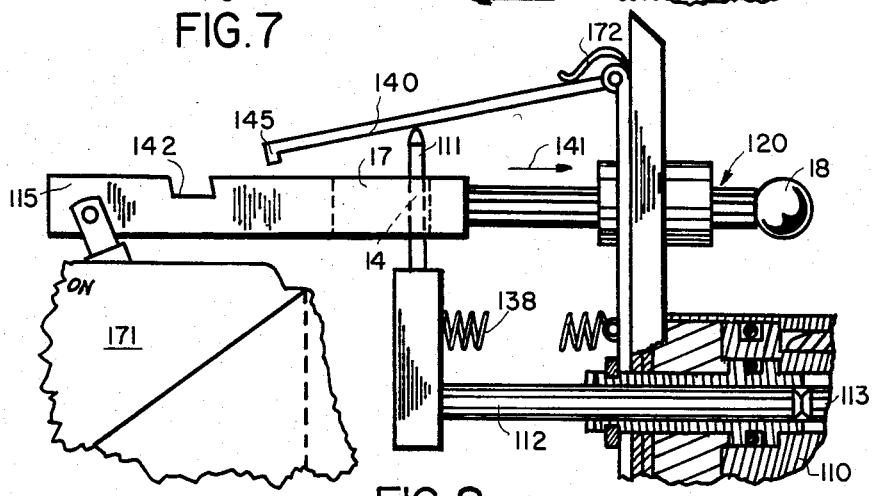
FIG. 8 is a fragmentary side view of the device of FIG. 7 with the plug inserted into the receptacle, and the circuit breaker in the ON position.

As evident from FIG. 8, the reverse operation is encountered when the plug pin is withdrawn from the receptacle assembly 110. The return spring 138 causes the plug follower upper end 111 to travel forward as indicated by direction indicating arrow 141. The forced travel of the manual operating handle assembly 120 returns the circuit breaker 171 to the OFF position. The latch notch 142 cannot pass under the notch grip 145 and is engaged therewith, thus precluding the reverse movement until the plug pin 113 is inserted in the receptacle assembly 110 as previously described in relation to FIG. 6.

Figure 9:
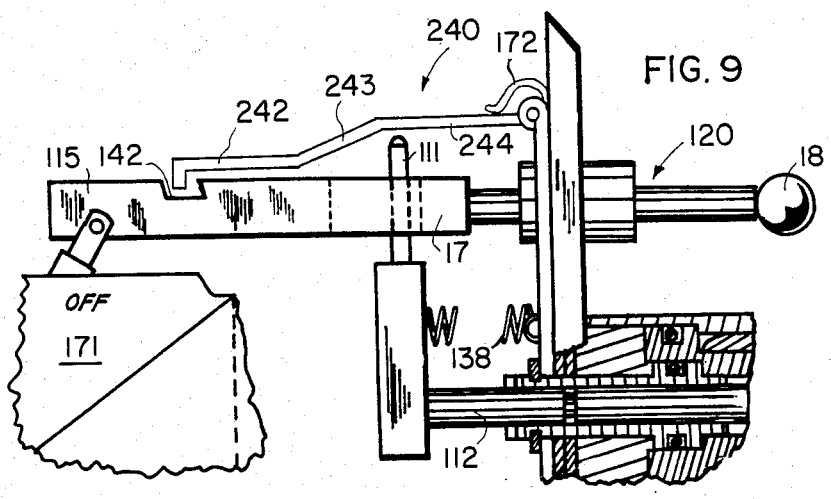
FIG. 9 is a fragmentary side view of the further alternate device, showing the mechanism prevented from being actuated, with the plug pin follower and the hinged latch in their respective positions prior to the plug being inserted into the receptacle in order to permit the mechanism to be actuated.

The hinged latch 140 or the leaf spring latch 40 or other form of latching member preferably has an extended body portion which interacts with the plug follower to produce a large amount of latching mechanism travel in response to a small amount of plug follower motion. As illustrated in FIG. 9, a latch 240 has an incline region 243 which forms an obtuse angle with the first region 242 amd the second region 244. The first region 242 and the second region 244 are essentially parallel to the actuating member 15 prior to the plug pin being inserted into the receptacle. It is evident from FIG. 10 that a small amount of motion of the plug pin follower 111 produces a rapid and large amount of motion of the notch engaging region 145 of the hinged latch 240.

The structure of the preferred embodiment provides the advantage of permitting greater force to be available at the notch grip region of the hinged latch 140 since the hinged latch need not be of a resilient spring or spring-like material.

It is thus evident that the hinged latch can be a two part member, with a spring region affixed to the housing 180, in the manner of the hinged latch 140 or 240 or a unitary structure in the manner of the leaf spring latch 40 of FIGS. 3, 4, and 5.

Figure 10:
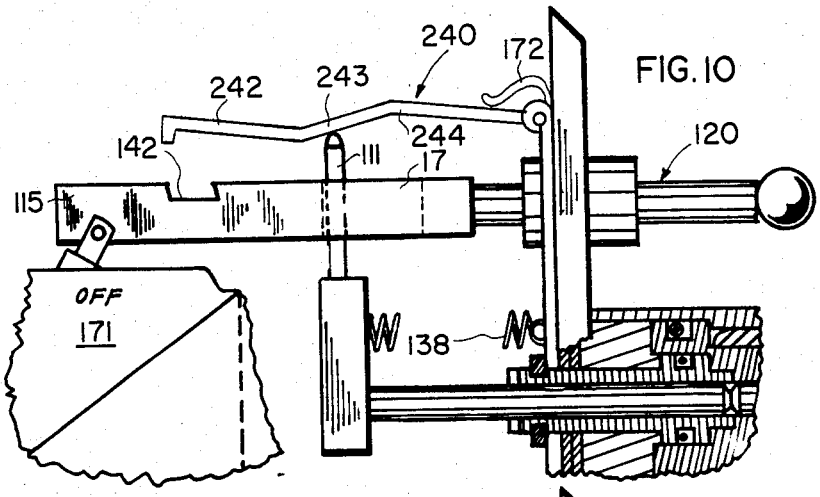
FIG. 10 is a fragmentary side view of the alternative device, showing the position of the plug pin follower and the hinged latch after the plug has been inserted into the receptacle, thereby permitting the mechanism to be actuated.
Figure 11:
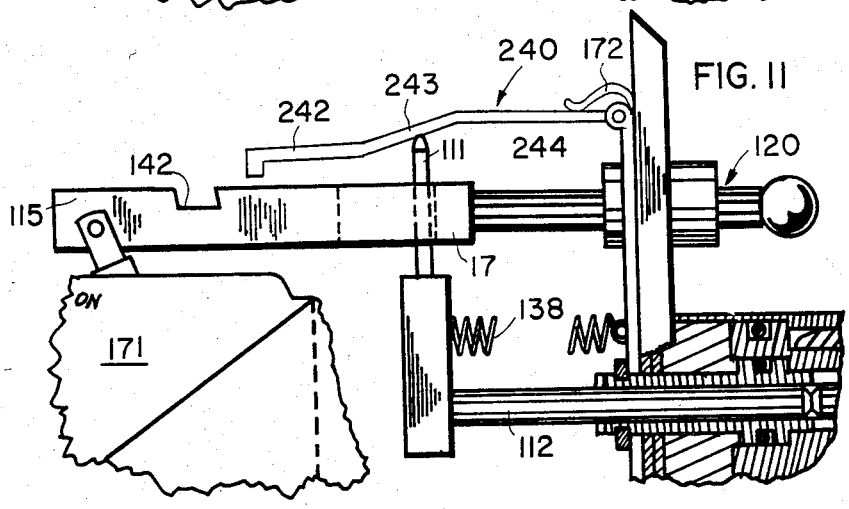
FIG. 11 is a fragmentary side view of the device of FIG. 9 with the plug inserted into the receptacle, and the circuit breaker in the ON position.

It should also be understood that the latch mechanism modification as illustrated in FIGS. 9, 10 and 11, can be employed in combination with the spring latch mechanism of FIGS. 3, 4, and 5.

What is claimed is:

1. In a waterproof device having means for opening and closing an electrical circuit and an electrical receptacle for receiving an electrical plug, the improvement which comprises:

a housing plug receiving means, said plug receiving means being fixed to said housing, a latching member;

electrical pin engaging means, said electrical pin engaging means having a main body region supported for movement within said plug receiving means between a first position and a second position, and a latching member engaging region extending substantially normal to said electrical pin engaging means main body region;

first spring biasing means for biasing said electrical pin engaging means for movement from said first position to said second position;

a circuit breaker;

circuit breaker actuating member, said circuit breaker having a first end which engages said circuit breaker actuating member and a second end which extends outside of said housing, and being mounted for movement from an actuating first position in which said circuit breaker actuating member causes said circuit breaker to be OFF, to a second position in which said circuit breaker actuating member causes said circuit breaker to be ON;

interconnecting means between said circuit breaker actuating member and said electrical pin engaging means, said interconnecting means causing said circuit breaker actuating member to move from said actuating first position to said actuating second position in response to movement of said electrical pin engaging means from said pin first position to said second pin position;

said latching member having a first end supported by said housing and a second end which engages said circuit breaker actuating member and precludes movement of said circuit breaker actuating member toward said second actuating position;

second spring biasing means associated with said latching member to bias said latching member for engagement with said circuit breaker actuating member;

said electrical pin engaging means being moveable in response to the insertion of an electrical pin into said electrical receptacle such that said electrical pin engaging means latching member engaging region causes said latching member to move against its spring bias out of engagement with said circuit breaker actuating member.

2. The apparatus of claim 1, wherein said second spring biasing means is a torsion spring.

3. The apparatus of claim 2, wherein said first spring biasing means is at least one coil spring.

4. The apparatus of claim 3, wherein said latching member is a leaf spring.

5. The apparatus of claim 1, wherein said circuit breaker actuating member has an elongated slot, said electrical pin engaging means has a region which extends through said circuit breaker actuating member elongated slot and engages said latching member and wherein said elongated slot functions as a lost motion connection.

6. The apparatus of claim 5, wherein said latching member is fixed at one end to said housing and at another end having circuit breaker actuating member engaging means.

7. The apparatus of claim 6, wherein said circuit breaker actuating member has a recess for receiving said circuit breaker actuating member engaging means and said engaging means is a flange region extending essentially normally from said latching member.

8. The apparatus of claim 7, wherein said latching member is spring biased by said second spring biasing means such that said flange region is forced toward said recess and is prevented from entering said recess when said electrical pin engaging means is in said second position and permitted to enter said recess when said electrical pin engaging means is in said first position.

9. The apparatus of claim 1, wherein said latching member includes a first and a second extended body portion which are essentially parallel to said circuit breaker actuating member prior to an electrical plug being inserted in said plug receiving means, said first and said second extended body portions being separated by an inclined region thereby providing an offset between said first and said second extended body portions.

* * * * *